United States Patent [19]

Muta

[11] Patent Number: 5,062,157

[45] Date of Patent: Nov. 5, 1991

[54] HEADBAND TOWEL

[76] Inventor: Theodore J. Muta, 1817 Fisher St., Munster, Ind. 46321

[21] Appl. No.: 667,834

[22] Filed: Mar. 12, 1991

Related U.S. Application Data

[63] Continuation-in-part of Ser. No. 567,841, Aug. 15, 1990, which is a continuation-in-part of Ser. No. 519,767, May 7, 1990, abandoned.

[51] Int. Cl.[5] ..... A41D 20/00; A41D 23/00

[52] U.S. Cl. ..... 2/171; 2/174; 2/181; 2/202; 2/207

[58] Field of Search ..... 2/171, 172, 174, 181, 2/202, 203, 207, DIG. 11

[56] References Cited

U.S. PATENT DOCUMENTS

| | | | |
|---|---|---|---|
| 3,671,977 | 6/1972 | Degnon | 2/207 |
| 4,468,818 | 9/1984 | Flannery | 2/207 |
| 4,914,754 | 4/1990 | Ruth | 2/207 |
| 4,964,175 | 10/1990 | Taylor | 2/171 |

FOREIGN PATENT DOCUMENTS

| | | | |
|---|---|---|---|
| 1187256 | 3/1959 | France | 2/207 |
| 1432470 | 2/1966 | France | 2/202 |
| 229872 | 3/1924 | United Kingdom | 2/207 |
| 833431 | 4/1960 | United Kingdom | 2/207 |

*Primary Examiner*—Werner H. Schroeder
*Assistant Examiner*—Gloria Hale
*Attorney, Agent, or Firm*—Philip Hill

[57] ABSTRACT

A towel serves additionally as a headband and head covering when held in place by extended strips which fasten together at the back of the head. The towel is pulled back over the head and held in place with fasteners placed on both the towel and the extended strips. It is pulled forward over the head, for removing perspiration and grime from the face and neck area, and conveniently returned over the head during activity. It is also useful to protect from heat or sun while doing heavy physical work, sports activities, lying on the beach, and the like.

Alternatively, the headband closure member comprises an elastic-containing band to effect a firm positioning about one's head.

20 Claims, 3 Drawing Sheets

Fig. 1
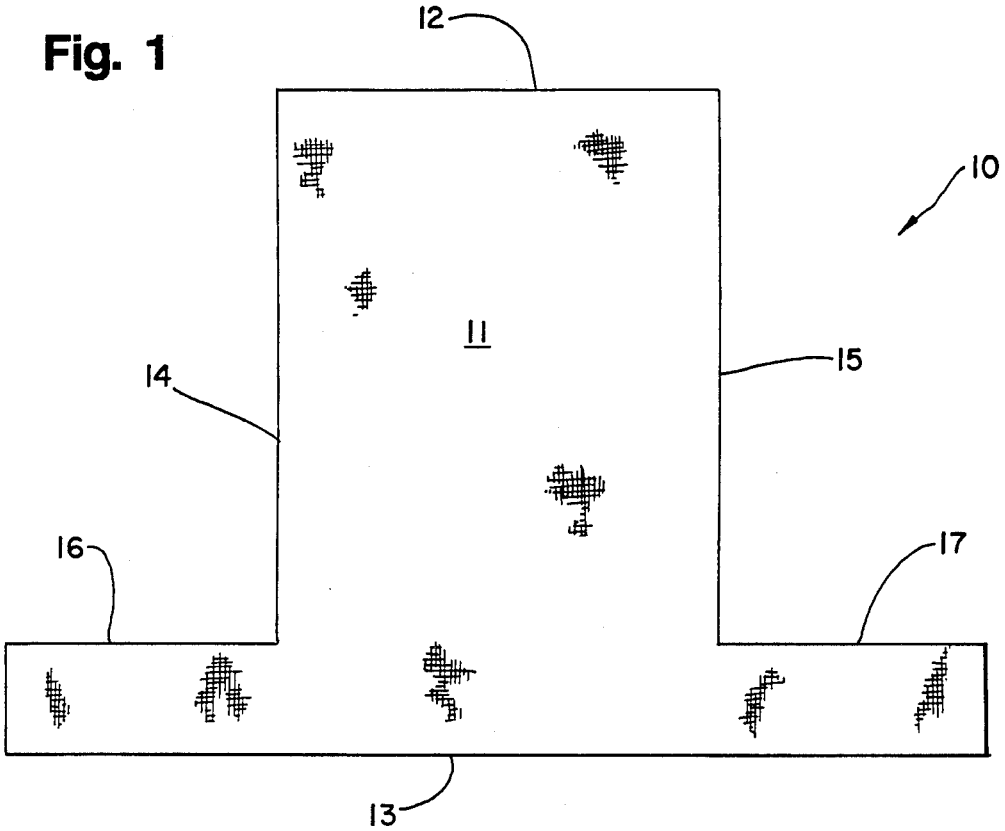
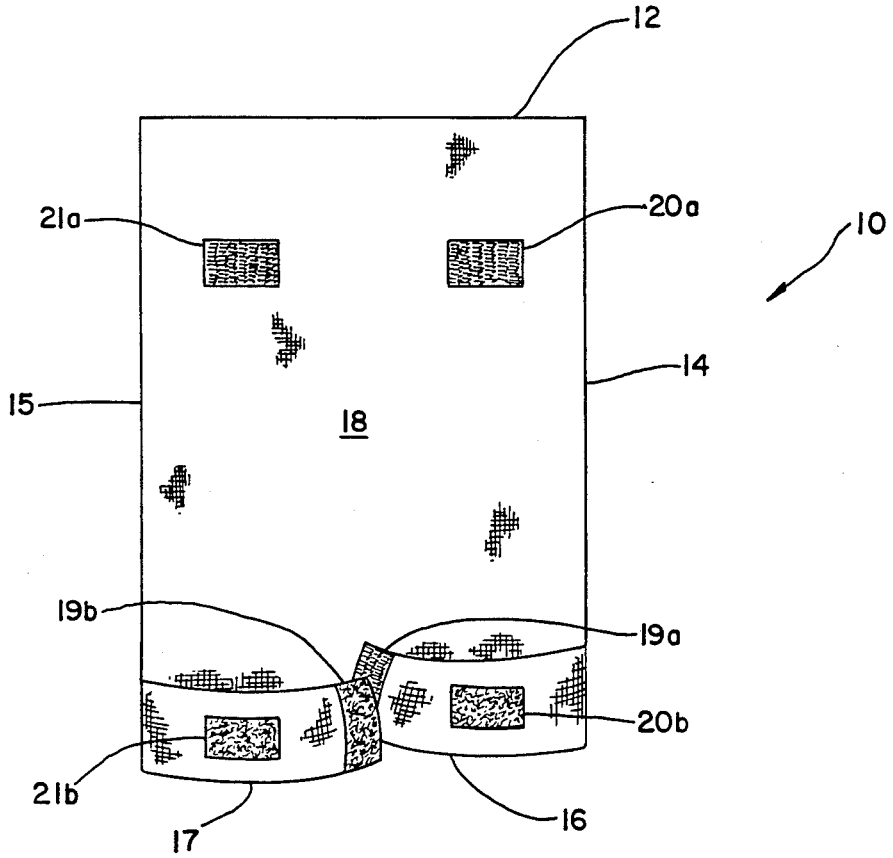
Fig. 2

Fig. 3
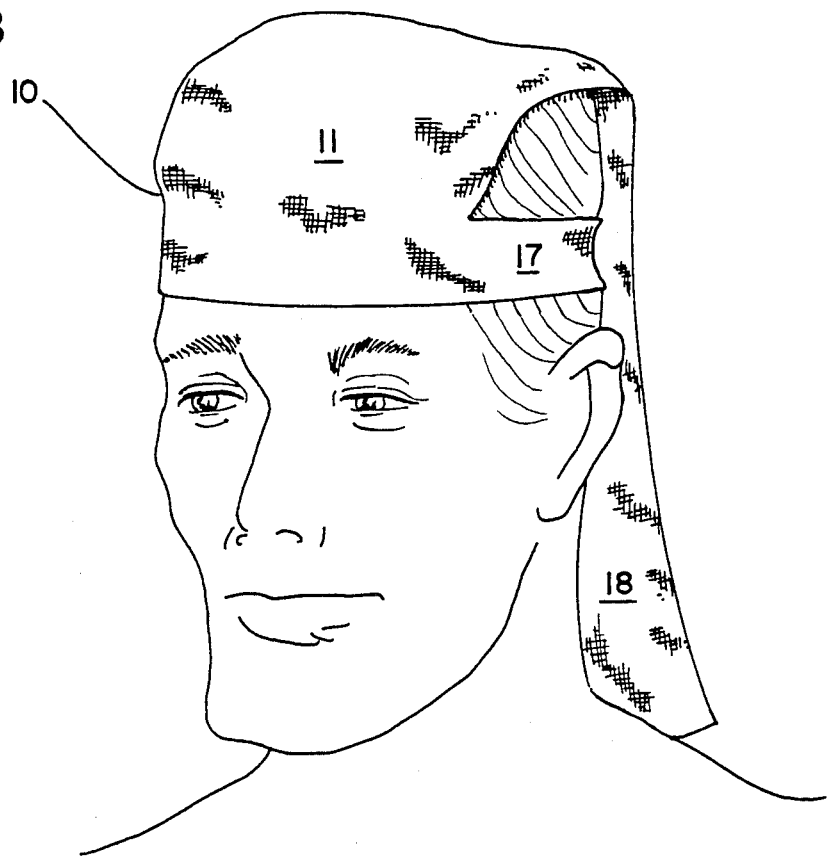
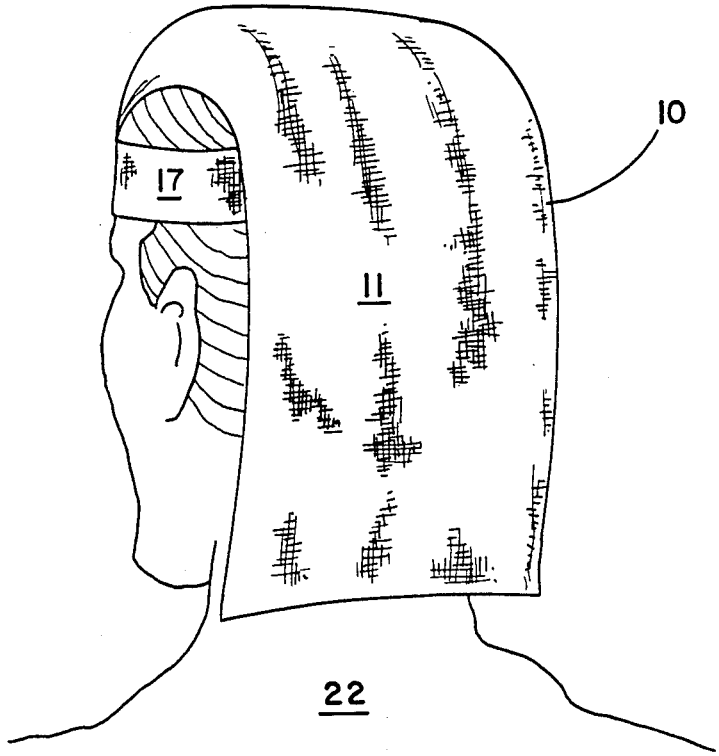
Fig. 4

HEADBAND TOWEL

The application is a continuation-in-part of application U.S. Ser. No. 07/567,841, filed Aug. 15, 1990, being a continuation-in-part of application U.S. Ser. No. 07/519,767, filed May 7, 1990, now abandoned.

BACKGROUND OF THE INVENTION

This invention relates to a head towel to remove perspiration or grime, particularly from one's face and neck, while also providing protection from heat, dirt, sun, and the like. The head towel is intended for use during heavy physical labor, exercising workouts, sports activities, sunning at the beach, and other recreational endeavors. The head covering is light in weight, open to the air, and convenient to use.

Headbands, or sweatbands, have been used for many years, in hot and in cold weather, both for removing perspiration and for warming the ears. A typical sweatband use, described in U.S. Pat. No. 1,434,854, employs absorbent pads held in place in a pouch upon one s forehead. U.S. Pat. No. 2,070,216 discloses a head band for use as ear muffs, constructed of selvaged panels of knitted material. U.S. Pat. No. 3,184,758 also relates to head bands devised to keep one's ears warm. U.S. Pat. No. 4,394,782 relates to a multi-purpose head sweatband, having a cloth member wrapped around one's head with flaps to cover the ears and indentation to provide good vision. This band serves equally to keep ears warm in cold weather. Design Pat. No. 277,330 relates to the same invention as the last patent above.

These and other items in the prior art relate principally to head bands. There remains a need for the head towel of this invention, particularly for use in summer weather or during vigorous physical exertion, which is convenient to carry and to use for removing perspiration or grime from the face area while also being effective in protecting one's head.

SUMMARY OF THE INVENTION

This invention relates to a fabric head towel, generally made of cloth, intended to be available to remove perspiration or grime from the area of the face and neck.

This invention also relates to a head towel covering to protect one's scalp and hair from heat, dirt, sun, and the like.

It is an object of this invention to provide a cloth towel member, fitted with side strips attached at one end of the towel member so that, when that end is placed against one's forehead, the strips may be extended around one's head and finally fastened together to provide a firm fit.

It is a further object of this invention to provide fastener means at positions selected to provide a firm retention of the towel member when it is drawn over the top of one's head for securing at the back of one's head.

It is a further object of this invention to provide, alternatively, an elastic band to serve, at least in part, as the closure unit for the cloth towel headband section. It is a still further object of this invention to provide a head covering having adequate ventilation during either work or play.

Other objects of this invention will become obvious during the following general discussion of the invention.

BRIEF DESCRIPTION OF THE DRAWINGS

Drawings, illustrative, without limitation, of this invention, are described briefly below.

FIG. 1 presents a schematic view of the towel with extended bands.

FIG. 2 presents a reverse schematic view of the towel, complete with fastener means, with bands folded to accommodate the backside of one's head.

FIG. 3 presents a side view of the headband towel in place and secured about the head.

FIG. 4 presents a rear view of the secured headband towel.

DETAILED DESCRIPTION OF THE INVENTION

Figure 5:
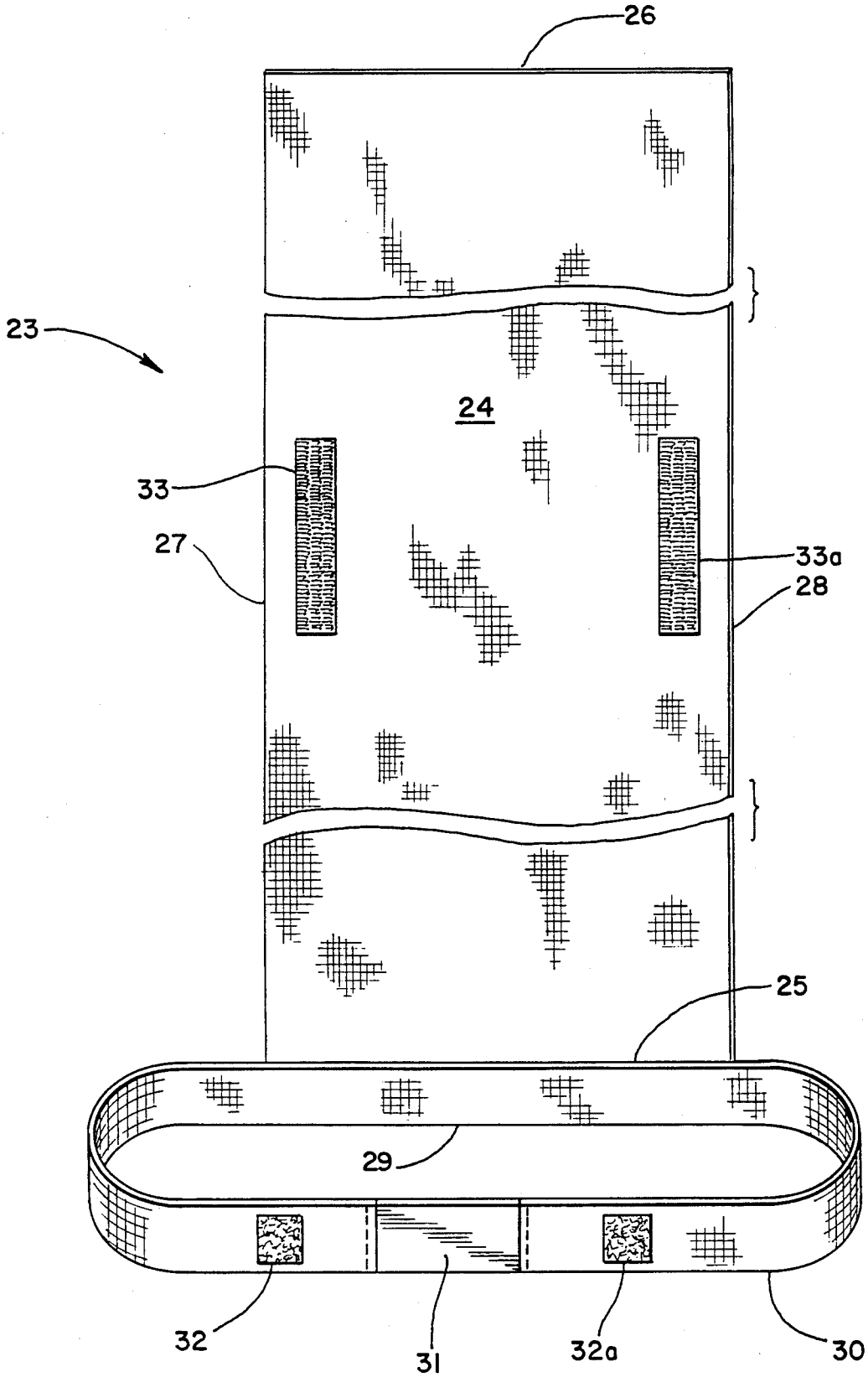
FIG. 5 presents a schematic view of the towel with a closed headband section, comprising a strip of textured material together with a minor length of an elastic section.

The invention of this application relates generally to a head towel for removing perspiration or grime, particularly from one's face and neck. It also serves as a head covering intended to provide protection of the head and scalp from heat, dirt, sun, and the like. This head towel unit is intended for use during heavy physical labor, exercising, jogging, other sports activities, sunning at the beach, and other recreational endeavors. The headband towel covering is light in weight, open to the air, and generally easy and convenient to use.

The headband towel of this invention provides the user with a unique and convenient place to carry a towel, when involved in any heavy physical activity, while still being readily accessible for use in removing dirt and perspiration. Secondarily, it serves as a head covering for protecting the scalp and hair. For example, the towel of this invention is intended to be pulled forward over the head, for removing perspiration from the face and neck area, and then conveniently returned over the head to be fastened in place during one's selected activity so that it will remain out of the way during exertion.

In a typical embodiment a towel headband, or head covering, comprises a planar, or flat, cloth section which has inner and outer surfaces, opposed sides, and opposed ends. Cloth strips extend outwardly at one end for a sufficient distance to at least extend around one's head. These strips are fitted with fastener means to provide a firm positioning of the inner surface of the towel against one's forehead. One or more additional fastener means are provided on the outer sides of the cloth strips and the inner surface of the towel to effect secure fastening at the rear when the towel is thrown backward over one's head to afford a head covering.

The towel material may be any suitable cloth material, whether made with natural fibers, synthetic fibers, or a mixture of the two. A preferred towel material is cotton, selected for its ready absorption of moisture. The configuration of the towel is preferably rectangular with the size selected with an eye to fitting comfortably over one's forehead and scalp while extending down over one's neck.

The towel material may also be any suitable paper or cellulosic, non-woven fabric material that may be discarded after use. Such paper material should have a sturdy texture while being absorbent. Multi-ply cellulosic towel material that is soft and pliable is especially suited to the uses of this invention.

The towel unit is intended to be held in place by any suitable type of fastener attached to the ends of two cloth, or towel, strips which extend outwardly from the end section of the towel. Such fasteners may comprise a button and buttonhole, a snap and corresponding receptacle, or a hook and eye unit. In other embodiments, the cloth strips may be tied in a knot, or bow, or may be pinned. In a preferred embodiment, the fastener sections comprise releasably cooperating, complementing sections of a material such as "Velcro" (trademark).

In another preferred embodiment, the end section of the towel is integral with a closure member including, at least in part, an elastic strip to describe a circular band, whereby the towel is held against one's forehead by the pressure induced by the elastic member. The towel end section may be sewn to the closure member. Alternatively, it may be connected to the closure member with a series of snaps, hooks, or other fasteners arranged to effect a union at that portion of the closure member intended to be positioned against one's forehead.

While serving in the form of a headband, or head covering, this towel unit is primarily fashioned to be readily removable for use as a conventional towel and, as desired, returned to its position. For example, in one preferred embodiment, the towel unit may be released from the rear fasteners and brought forward over the face for use as a towel to remove perspiration or grime.

The drawings associated herewith are illustrative of preferred embodiments of this invention.

FIG. 1 presents a general representation of a rectangular head towel 10, including outer surface 11, first end 12, second end 13, first side 14, second side 15, first extended strip 16, and second extended strip 17. The towel is fashioned from a textured material such as cotton terry cloth and the extended strips are made of the same material. The strips are long enough to extend around one's head with the inclusion of added length to provide for an overlap to accommodate fastener units. This provides a snug fit when the second end of the towel is placed upon one's forehead. The sides are long enough to extend over one's head to provide coverage for the neck area.

FIG. 2 presents a general representation of the towel 10 when reversed to show inner surface 18. Fastener units 19*a* and 19*b* are located at the ends of the extended strips 16 and 17, respectively. Fastener units 20*a* and 21*a* are located upon inner surface 18 and positioned to interact with complementing fastener units 20*b* and 21*b* when the towel is pulled back over one's head. The fastener units shown in FIG. 2 are fashioned from "Velcro" (trademark).

In FIG. 3, the headband towel 10 is shown in place, employing the parts shown in FIGS. 1 and 2, including a portion of extended strip 17, outer surface 11, and inner surface 18. Similarly, in FIG. 4, a rear view of the secured headband towel 10 shows outer surface 11 extending down to the shoulder area 22 while secured to portions of extended strip 17 and extended strip 16 (not shown) by fastener units (not shown) located on the extended strips and matched by complementing units on the inner surface (not shown) of the towel.

FIG. 5 presents a general representation of a rectangular head towel 23, including inner surface 24, first opposed end 25, second opposed end 26, first side 27, second side 28, inner side 29 of an attached elastic-containing strip, and outer side 30 of the attached elastic-containing strip. The elastic-containing strip may be fashioned entirely of an elastic strip or, optionally, may be fashioned principally of a textured material having a minor length of an insert elastic section 31.

In the same manner shown in FIG. 2, fastener units 32 and 32*a* are located on the outer side 30 of the elastic-containing strip to interact with complementing fastener units 33 and 33*a* located upon inner surface 24.

I claim:

1. A fabric head towel, conveniently carried about the head while also serving as a head covering for protecting one's head from heat, dirt, sun, and other environmental elements comprising:

a) a planar fabric material section, having inner and outer surfaces, opposed sides, and first and second opposed ends;

b) two elongated fabric material strips, extending from either side at the first opposed end, said strips having sufficient length to at least extend horizontally around one's head, and having interacting first fastener means sections incorporated in respective end sections of the elongated fabric material strips, for closably effecting a firm positioning of the fabric material section around one's head when the first opposed end is positioned upon one's forehead;

c) at least one second fastener means section, incorporated in an outer surface of the elongated fabric material strips and positioned to be accessible outwardly from the back of one's head; and d) third fastener means sections, interactive with said second fastener means sections, positioned upon the inner surface of the planar fabric material section to interact closably with respective second fastener means sections whenever the second opposed end is urged backwardly over the surface of one's head, whereby the head covering is firmly secured to provide protection.

2. The fabric head towel of claim 1 wherein the fabric material comprises cloth.

3. The fabric head towel of claim 1 wherein the fabric material comprises a cellulosic, non-woven fabric material.

4. The fabric head towel of claim 1 wherein the various fastener means sections comprise releasably cooperating complementing sections.

5. The fabric head towel of claim 1 wherein the interacting first fastener means sections comprise additional elongated fabric strips having sufficient length to effect closure by tying the elongated fabric strips in a knot.

6. The fabric head towel of claim 1 wherein the fabric head towel is made of an absorbent material.

7. The fabric head towel of claim 6 wherein the absorbent material is textured.

8. The fabric head towel of claim 6 wherein the absorbent material comprises fibers.

9. The fabric head towel of claim 6 wherein the absorbent material comprises synthetic fibers.

10. The fabric head towel of claim 6 wherein the absorbent material comprises a mixture of natural and synthetic fibers.

11. A fabric towel head covering, for protecting one's head from heat, dirt, sun, and the like, comprising:

a) a planar fabric material section, having inner and outer surfaces, opposed sides, and first and second opposed ends;

b) a closed elastic-containing strip, attached at the first opposed end, said strip having sufficient length to be extended horizontally around one's head, for effecting a firm positioning of the elastic-containing strip around one's head when the first opposed end is positioned upon one's fore c) at least one first fastener means section, incorporated in an outer surface of the closed elastic strip and positioned to be accessible outwardly from the back of one's head; and second fastener means sections, interactive with said first fastener means sections, positioned upon the inner surface of the planar fabric material section to interact closably with respective first fastener means sections whenever the second opposed end is urged backwardly over the surface of one's head, whereby the head covering is firmly secured to provide protection.

12. The fabric towel head covering of claim 11 wherein the fabric comprises cloth.

13. The fabric towel head covering of claim 11 wherein the various fastener means sections comprise releasably cooperating complementing sections.

14. The cloth towel head covering of claim 12 wherein the cloth towel is made of an absorbent material.

15. The cloth towel head covering of claim 14 wherein the absorbent material is textured.

16. The fabric towel head covering of claim 11 wherein the closed elastic-containing strip comprises solely an elastic strip intended to extend horizontally around one's head.

17. The fabric towel head covering of claim 11 wherein the closed elastic-containing strip comprises a major length of a textured material together with an inserted minor length of an elastic strip.

18. The cloth towel head covering of claim 14 wherein the absorbent material comprises a natural fiber cloth material.

19. The cloth towel head covering of claim 14 wherein the absorbent material comprises a synthetic fiber cloth material.

20. The cloth towel head covering of claim 14 wherein the absorbent material comprises a mixture of natural and synthetic fiber cloth materials.

* * * * *